US007096114B2

(12) United States Patent
Feray

(10) Patent No.: US 7,096,114 B2
(45) Date of Patent: Aug. 22, 2006

(54) METHOD OF REGULATING A TRANSPORT SYSTEM

(75) Inventor: Gilles Feray, Paris (FR)

(73) Assignee: Alstom, Paris (FR)

( * ) Notice: Subject to any disclaimer, the term of this patent is extended or adjusted under 35 U.S.C. 154(b) by 194 days.

(21) Appl. No.: 10/663,761

(22) Filed: Sep. 17, 2003

(65) Prior Publication Data

US 2004/0138805 A1 Jul. 15, 2004

(30) Foreign Application Priority Data

Sep. 26, 2002 (FR) ..... 02 11897

(51) Int. Cl.

| | |
|---|---|
| ***G06G 1/00*** | (2006.01) |
| ***G06G 7/76*** | (2006.01) |
| ***G06G 7/78*** | (2006.01) |
| ***G06G 1/123*** | (2006.01) |

(52) U.S. Cl. ..... 701/117; 701/118; 701/119; 340/994

(58) Field of Classification Search ..... 701/117–119, 701/200–202, 23–26, 204; 340/905, 934, 340/936, 988, 994

See application file for complete search history.

(56) References Cited

U.S. PATENT DOCUMENTS 5,168,451 A * 12/1992 Bolger ..... 701/117
5,806,877 A 9/1998 Huang

FOREIGN PATENT DOCUMENTS

| | | | |
|---|---|---|---|
| EP | 0479132 | A1 | 4/1992 |
| EP | 1364603 | A2 | 11/2003 |
| FR | 2 388 357 | A | 11/1978 |
| GB | 2363365 | A | 12/2001 |
| GB | 2375956 | A | 12/2002 |
| WO | WO 98 08206 | A | 2/1998 |

* cited by examiner

*Primary Examiner*—Yonel Beaulieu
(74) *Attorney, Agent, or Firm*—Sughrue Mion, PLLC

(57) ABSTRACT

A method of regulating traffic in a transport system in which vehicles travel on a line provided with a plurality of stations at which passengers can board and alight, wherein the running of the vehicles is regulated as a function of the passenger load on said vehicles, said load being determined by measuring the weight of passengers present in the vehicles.

5 Claims, 2 Drawing Sheets

METHOD OF REGULATING A TRANSPORT SYSTEM

The invention relates to a method of regulating traffic in a transport system in which vehicles travel on a track provided with a plurality of stations.

BACKGROUND OF THE INVENTION

In transport systems, it is known that traffic can be regulated by controlling it as a function of time. In particular, for subway trains, it is known that the running of the vehicles can be controlled so that the time interval between two vehicles is substantially constant. Such a regulation method offers the advantage of limiting the waiting time for which passengers wait in the stations, and of contributing to distributing the passenger load satisfactorily between the various vehicles when the flow of passengers reaching a subway station is regular. However, in practice, the flow of passengers reaching a subway station is irregular, in particular when the station makes it possible for passengers to change subway lines. Thus, a large influx of passengers at any point in time usually gives rise to overloading of the first subway train to reach the station, and to underloading of the next train, since the majority of the passengers waiting on the platform prefer to squeeze into the first train.

OBJECTS AND SUMMARY OF THE INVENTION

An object of the present invention is thus to remedy those drawbacks by providing a method of regulating traffic in a transport system that makes it possible to improve the distribution of the number of passengers between the various vehicles in the transport system, and that is simple and inexpensive to implement.

The invention provides a method of regulating traffic in a transport system in which vehicles travel on a line provided with a plurality of stations at which passengers can board and alight.

In the invention, in the regulation method, the running of the vehicles is regulated as a function of the passenger load on said vehicles, said load being determined by measuring the weight of passengers present in the vehicles.

According to another characteristic of the invention, the weight of passengers present in the vehicles is measured by means of load sensors equipping the bogies of the vehicles.

According to yet another characteristic of the invention the regulation method comprises the following steps:

monitoring the passenger load on the vehicles by measuring the weight of passengers in the vehicles;

detecting whether each vehicle is in an overloaded state by comparing the weight of passengers as measured with an overload threshold assigned to each vehicle; and modifying the running of the vehicles traveling on the line by acting at each station at which an overloaded vehicle arrives to reduce the time interval between the departure of the overloaded vehicle and the departure of the preceding vehicle.

According to another characteristic of the invention, the overload threshold corresponds to the weight of passengers for which the proximity between the people in the vehicle is such that the journey becomes uncomfortable.

According to another characteristic of the invention, when no vehicle is in an overloaded state, the traffic is regulated on the basis of time so that the vehicles are separated by a constant time interval, the lapse of time for which the vehicles stop in the stations also being constant.

BRIEF DESCRIPTION OF THE DRAWINGS

The objects, features, and advantages of the present invention will be better understood on reading the following description of a particular implementation of the invention, given by way of non-limiting example, and with reference to the accompanying drawings, in which.

MORE DETAILED DESCRIPTION

To make the drawings clearer, only those elements which are necessary to understand the invention are shown. Like elements are given like references from one figure to another.

Figure 1:
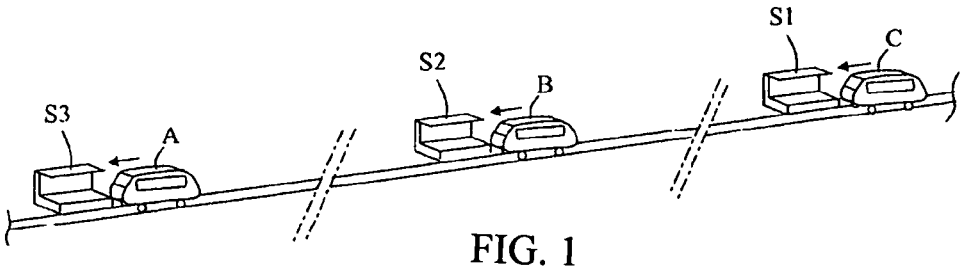
FIG. 1 is a diagrammatic view of a transport system line equipped with a central regulation unit implementing the regulation method of the invention.

FIG. 1 shows a transport system of the subway or tramway type having a railway line having at least three stations S1, S2, and S3, each of which is provided with a boarding platform. In particular, three vehicles A, B, and C travel on said line, and their movement is controlled by a central regulation unit.

The central regulation unit has a nominal operating mode in which the traffic is regulated as a function of time, each vehicle leaving a station at a given scheduled time and being separated from another vehicle by a constant time interval. This nominal operating mode is used so long as the passenger load in each of the vehicles does not exceed an overload threshold assigned to the vehicle, the passenger load being determined by measuring the weight of passengers present in the vehicle, e.g. by means of sensors disposed on each of the bogies of the vehicle. The overload threshold for each of the vehicles may be determined experimentally, and corresponds, for example, to the weight of passengers for which the proximity between the people is such as to make the journey uncomfortable.

In the invention, when the central regulation unit is warned of an overloaded state on a vehicle, e.g. by receiving a signal transmitted by the vehicle in the overloaded situation, the central regulation unit modifies the speed of certain vehicles and/or the lapse of time for which certain vehicles are stopped compared with the nominal operating mode, so as to reduce the number of passengers likely to board the overloaded vehicle. The overload signal transmitted by the vehicles may, for example, be communicated to the central regulation unit by communication means with which the vehicles are usually equipped, such as by radio waves that are free or that are guided via a waveguide disposed along the edge of the rail track.

Figure 2A:
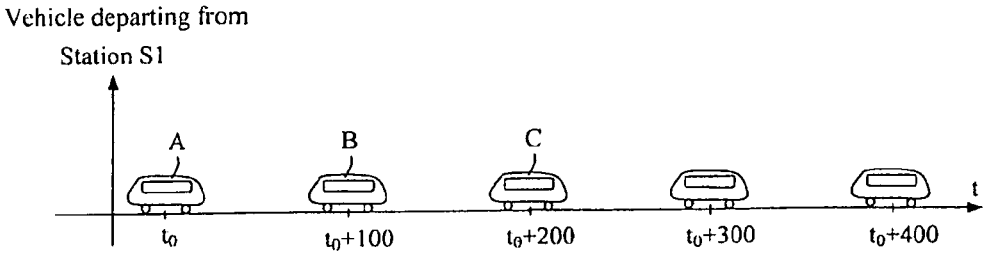
FIGS. 2A–2C show three graphs respectively giving the times of departure of the vehicles from three successive stations, in a first implementation of the regulation method of the invention.
Figure 2B:
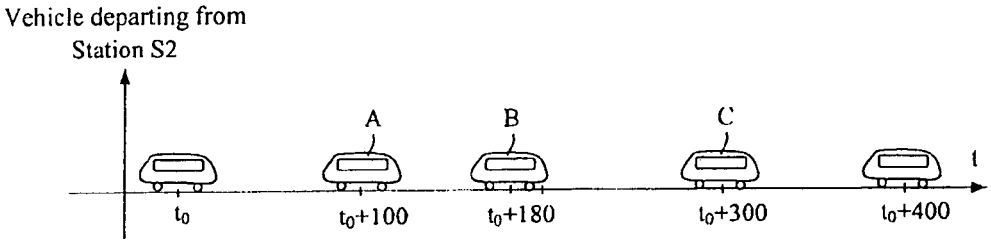
Figure 2C:
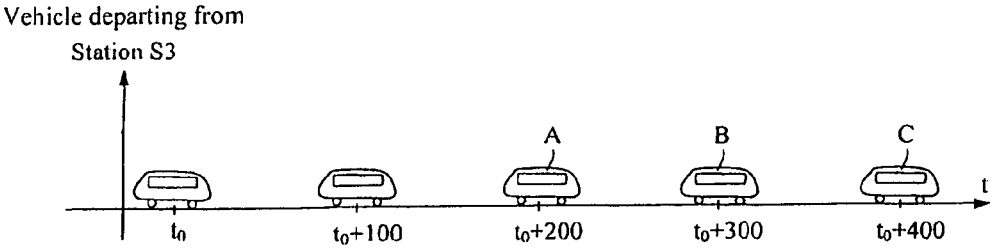

By way of example, FIGS. 2A through 2C show a first implementation of the regulation method of the invention, in which the vehicles that are overloaded are accelerated temporarily until they reach the next station, so that they leave it early relative to the initially scheduled times, and then they are slowed down on the section leading to the following station, so that they leave it on time relative to the initially scheduled times.

In the example, it is assumed that the lapse of time for which the vehicles are stopped at each station is invariable, e.g. about 20 seconds, and that under nominal operating conditions, i.e. when none of the vehicles A, B, and C are in an overloaded state:

vehicle A leaves station S1 at $t_0$, it leaves station S2 at $t_0$+100 seconds (s), and it leaves station S3 at $t_0$+200 s;

vehicle B leaves station S1 at $t_0$+100 s, it leaves station S2 at $t_0$+200 s, and it leaves station S3 at $t_0$+300 s; and vehicle C leaves station S1 at $t_0$+200 s, it leaves station S2 at $t_0$+300 s, and it leaves station S3 at $t_0$+400 s.

When the number of passengers boarding vehicle B at station S1 is such that vehicle B is in the overloaded state, the central regulation unit then automatically receives an overload signal from vehicle B, said overload signal being generated by vehicle B on the basis of load sensors present on its bogies. On the basis of this information, the central regulation unit causes the overloaded vehicle B to depart from station S1 at the scheduled time, but orders vehicle B firstly to accelerate between stations S1 and S2 to above the acceleration set under nominal operating conditions so that said vehicle B arrives 20 seconds early at station S2, and leaves station S2 at $t_0$+180 s instead of $t_0$+200 s. The central regulation unit then orders vehicle B secondly to slow down between stations S2 and S3 compared with the speed set in the nominal operating conditions so that vehicle B leaves station S3 at the initially scheduled time $t_0$+300 s.

By means of this regulation, the time interval between the times of departure of vehicles A and B from station S2 is 80 seconds instead of 100 seconds, thereby reducing the number of people reaching the platform of station S2 during this time interval and thus causing fewer people than normal to board vehicle B at station S2. Conversely, at station S2, the time interval between the time of departure of vehicle C and the time of departure of the preceding vehicle B is 120 seconds instead of 100 seconds under normal conditions, thereby giving people more time to reach the boarding platform and thus increasing the number of people likely to board vehicle C at station S2. The result of the regulation method of the invention is to transfer the number of passengers in vehicle B indirectly to vehicle C.

Figure 3A:
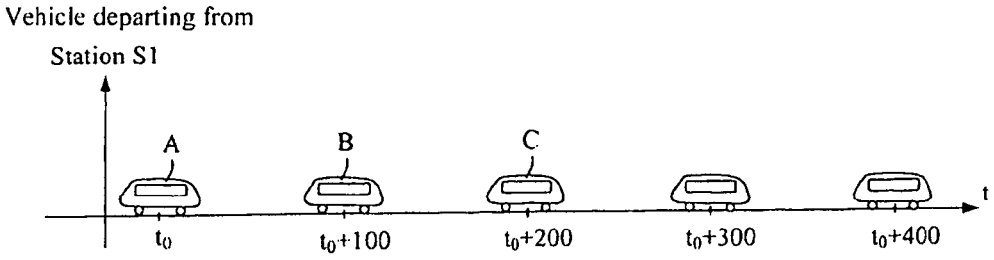
FIGS. 3A–3C show three graphs similar to the graphs in FIGS. 2A–2C for a second implementation of the regulation method of the invention.
Figure 3B:
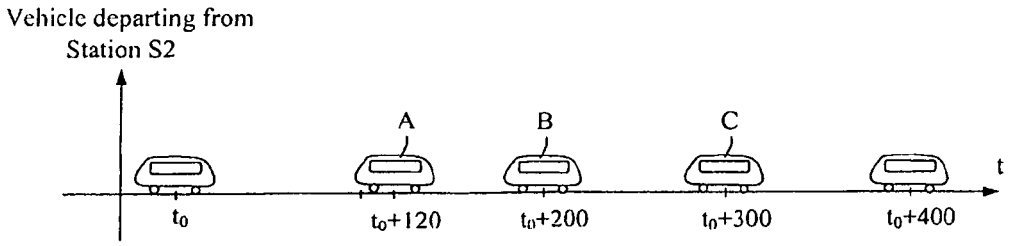
Figure 3C:
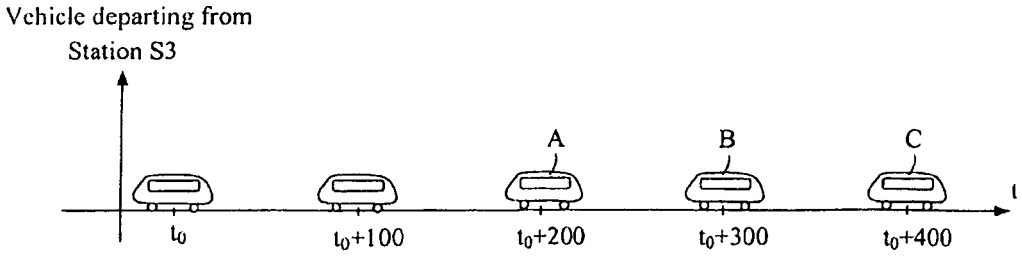

By way of example, FIGS. 3A through 3C show a variant implementation of the regulation method of the invention in which, when a vehicle is in an overloaded state at a station, the lapse of time for which the vehicle preceding the overloaded vehicle stops at the following station is extended so that said preceding vehicle leaves said following station late relative to the initially scheduled time, the speed of said preceding vehicle then being increased over its journey to the next station, so that it leaves said next station at the initially scheduled time. In this example, the nominal operating conditions of the transport system are identical to those described above, i.e. the time interval between the vehicles A, B, and C is 100 seconds under normal conditions.

Thus, under nominal operating conditions, i.e. when no vehicle is in an overloaded state, the central regulation unit controls the running of the vehicles A, B, and C such that:

vehicle A leaves station S1 at $t_0$, it leaves station S2 at $t_0$+100 s, and it leaves station S3 at $t_0$+200 s;

vehicle B leaves station S1 at $t_0$+100 s, it leaves station S2 at $t_0$+200 s, and it leaves station S3 at $t_0$+300 s; and vehicle C leaves station S1 at $t_0$+200 s, it leaves station S2 at $t_0$+300 s, and it leaves station S3 at $t_0$+400 s.

When the number of passengers boarding vehicle B at station S1 is such that vehicle B is in an overloaded state, an overload signal is sent automatically by vehicle B to the central regulation unit which then modifies the running of vehicle A by extending the lapse of time for which it stops at station S2 to time $t_0$+120 s instead of $t_0$+100 s as initially scheduled. Vehicle A then leaves station S2 at time $t_0$+120 s, and the central regulation unit orders vehicle A to be accelerated between stations S2 and S3 so that vehicle A arrives at and departs from station S3 at the initially scheduled times. The other vehicles, and in particular vehicles B and C continue along their way without their times being modified.

As a result of this regulation, at station S2, the time interval between the departure of vehicle B and the departure of the preceding vehicle A is reduced to 80 seconds instead of 100 seconds under nominal operating conditions. As a result, the number of people likely to reach the platform of station S2 during said time interval is reduced, and thus the number of people boarding vehicle B at station S2 is reduced. Conversely, the time interval between the departure of vehicle A from station S2 and the departure of the preceding vehicle is increased to 120 seconds instead of 100 seconds under normal conditions, thereby increasing the number of people likely to be present on the platform of station S2 and to board vehicle A. As a result, passenger load is transferred indirectly from vehicle B to vehicle A.

The regulation method of the invention offers the advantage of enabling the passengers to be distributed better between the vehicles when a sudden influx of passengers arrives on the platform of a station. In addition, by using measurement of the weight of the vehicle to estimate the number of passengers present in the vehicle, the regulation method of the invention offers the advantage being very inexpensive to implement since the bogies of the vehicles are usually equipped with weight sensors for safety reasons, it being possible for the information delivered by said sensors to be used advantageously by the regulation method without requiring additional sensors.

Naturally, the invention is in no way limited to the implementation described and shown, which is given merely by way of example. Thus, the regulation method may act differently on the running of the vehicles to obtain a reduction in the number of passengers likely to board the overloaded vehicles.

What is claimed is:

1. A method of regulating traffic in a transport system in which vehicles travel on a line provided with a plurality of stations at which passengers can board and alight, a running of the vehicles being regulated as a function of a passenger load on said vehicles, the method comprising:

monitoring the passenger load on the vehicles by measuring a weight of the passengers in the vehicles;

detecting whether each vehicle is in an overloaded state by comparing the weight of passengers as measured with an overload threshold assigned to each vehicle; and modifying the running of the vehicles traveling on the line by acting at each station at which an overloaded vehicle arrives to reduce a time interval between a departure of the overloaded vehicle and the departure of a preceding vehicle.

2. A method of regulating traffic in a transport system according to claim 1, wherein the weight of passengers present in the vehicles is measured by means of load sensors equipping the bogies of the vehicles.

3. A method of regulating traffic according to claim 1, wherein, when no vehicle is in the overloaded state, the running of the vehicles is regulated as a function of time so that the vehicles are separated by a constant time interval, a lapse of time for which the vehicles stop in the stations also being constant.

4. A method of regulating traffic according to claim 1, wherein, when a vehicle is in the overloaded state at a station, a speed of said vehicle is accelerated to a next station so that it leaves said next station early relative to an initially scheduled time, the vehicle then being slowed down during its journey to a following station so as to leave said following station at the initially scheduled time.

5. A method of regulating traffic according to claim 1, wherein, when a vehicle is in the overloaded state at a station a lapse of time for which a vehicle preceding the overloaded vehicle stops is increased at a next station so that the vehicle leaves said next station late relative to an initially scheduled time, the speed of the vehicle then being increased during its journey to a following station so that it leaves said following station at the initially scheduled time.

* * * * *